US005984244A

United States Patent [19]

Hirschovits et al.

[11] Patent Number: 5,984,244

[45] Date of Patent: Nov. 16, 1999

[54] MOUSE SUPPORT

[76] Inventors: Adiel Hirschovits, Paasitie 28-32 C, FIN-00830, Helsinki; Robert Skurnik, Ruorikuja 2 D 48, FIN-02320, Espoo; Antti Limingoja, Haukilahdenranta 13 A, FIN-02170 Espoo, all of Finland

[21] Appl. No.: 08/557,011

[22] PCT Filed: Jun. 3, 1994

[86] PCT No.: PCT/FI94/00235

§ 371 Date: Dec. 7, 1995

§ 102(e) Date: Dec. 7, 1995

[87] PCT Pub. No.: WO94/28763

PCT Pub. Date: Dec. 22, 1994

[30] Foreign Application Priority Data

| | | | |
|---|---|---|---|
| Jun. 7, 1993 | [FI] | Finland | 930341 U |
| Jan. 31, 1994 | [FI] | Finland | 940449 |

[51] Int. Cl.[6] ..... B43L 15/00

[52] U.S. Cl. ..... 248/118; 248/118.1; 248/231.71

[58] Field of Search ..... 248/118, 118.1, 248/118.5, 118.3, 278.1, 282.1, 231.71, 229.25, 230.6

[56] References Cited

U.S. PATENT DOCUMENTS

| | | | |
|---|---|---|---|
| 981,979 | 1/1911 | Collins . | |
| 1,801,637 | 4/1931 | Nichols | 248/231.71 |
| 2,227,786 | 1/1941 | La Fee . | |
| 2,468,473 | 4/1949 | Underwood . | |
| 2,549,753 | 4/1951 | Ashman | 108/45 |
| 3,697,033 | 10/1972 | Jacobs | 248/231.71 |
| 3,746,295 | 7/1973 | Stepanek et al. | 248/447.2 |
| 4,562,987 | 1/1986 | Leeds et al. | 248/278.1 |
| 4,733,618 | 3/1988 | Sarro et al. | 248/282.1 X |
| 4,844,388 | 7/1989 | Kuba et al. | 248/282.1 X |
| 4,974,808 | 12/1990 | Ball | 248/639 |
| 5,228,655 | 7/1993 | Garcia et al. | 248/918 X |
| 5,242,139 | 9/1993 | Aldrich | 248/118 |
| 5,340,075 | 8/1994 | Schriner | 248/346.01 |
| 5,379,973 | 1/1995 | Rader | 248/118.1 |
| 5,730,408 | 3/1998 | McAllister et al. | 248/288.51 |

FOREIGN PATENT DOCUMENTS

| | | |
|---|---|---|
| 130733 | 4/1975 | Germany . |
| 136852 | 8/1952 | Sweden . |
| 190095 | 6/1937 | Switzerland . |
| WO 8605974 | 10/1986 | WIPO . |
| WO 8900111 | 1/1989 | WIPO . |
| WO 9012523 | 11/1990 | WIPO . |
| WO 9106233 | 5/1991 | WIPO . |
| WO 9114384 | 10/1991 | WIPO . |

*Primary Examiner*—Leslie A. Braun
*Assistant Examiner*—Anita M. King
*Attorney, Agent, or Firm*—Skinner and Associates

[57] ABSTRACT

A mouse support including a unitary plate-like base part, a U-shaped attachment part having an upper leg and a lower leg, and a threaded tightening part. The lower leg has an aperture through which the tightening part extends. The tightening part secures the attachment part to the edge of a plate-like structure. The base part has a portion which overlaps with the lower leg, and further has an aperture through which the tightening part extends. The base part swivels between a use position and a storage position around the tightening part.

7 Claims, 1 Drawing Sheet

MOUSE SUPPORT

This invention concerns a computer mouse support and more specifically a plate-like support on which it is possible to move and store a mouse.

Many types of mouse support are known nowadays. Most commonly they are formed from a plate-like part whose upper surface is covered with a suitable material, on top of which the mouse ball is rolled. They are usually equipped with a raised part whose purpose is to support the wrist of the person operating the mouse. At its most simple, the mouse support is, however, a piece of plastic sheet on which the mouse is moved.

One technical drawback of these mouse supports is their fixed location. Almost without exception the supports are located on top of a table beside a computer keyboard, where they take up space and occupy a specific location until that location is moved. Changing the place of a mouse support by picking it up from the table and relocating it is an awkward task, because sliding the support has usually been made difficult in order to ensure that it stays in place.

The purpose of this invention is to achieve an improvement to the technical drawbacks of mouse supports, and to make a mouse support that may be removed if necessary, but which is easily available and ready to use. In addition, the purpose is to make a mouse support that may be installed in different positions.

The benefits of the invention are accomplished by a solution whose characteristic features are described in the attached claims.

The invention is described in more detail in the following pages with reference to the attached drawings, in which.

Figure 1:
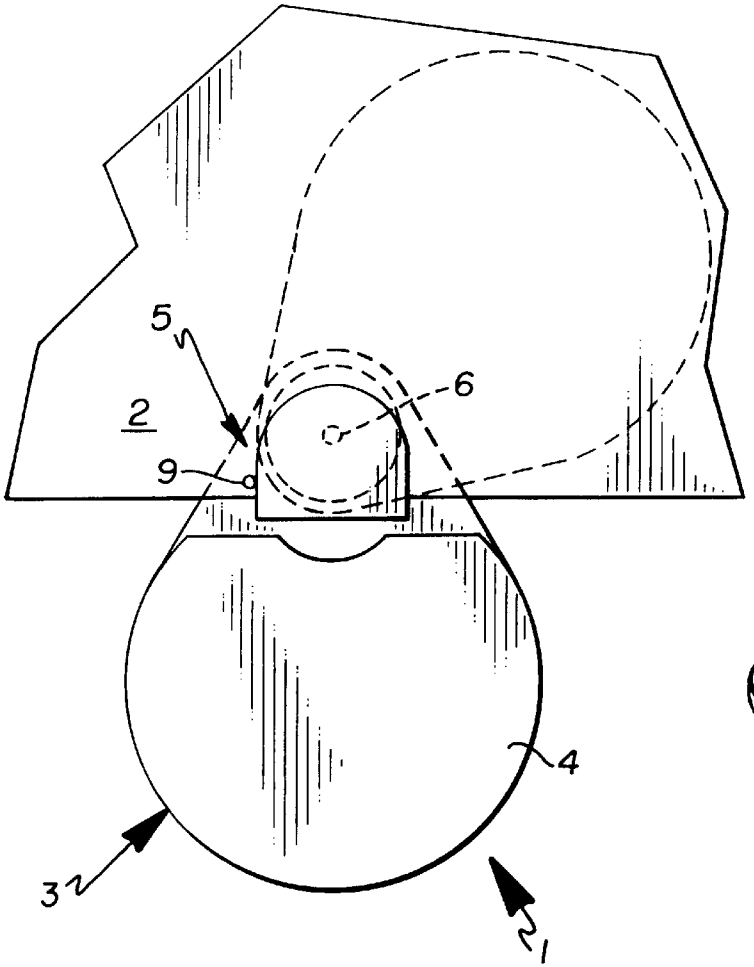
FIG. 1 is a view of a mouse support in accordance with the invention seen from directly above.
Figure 2:
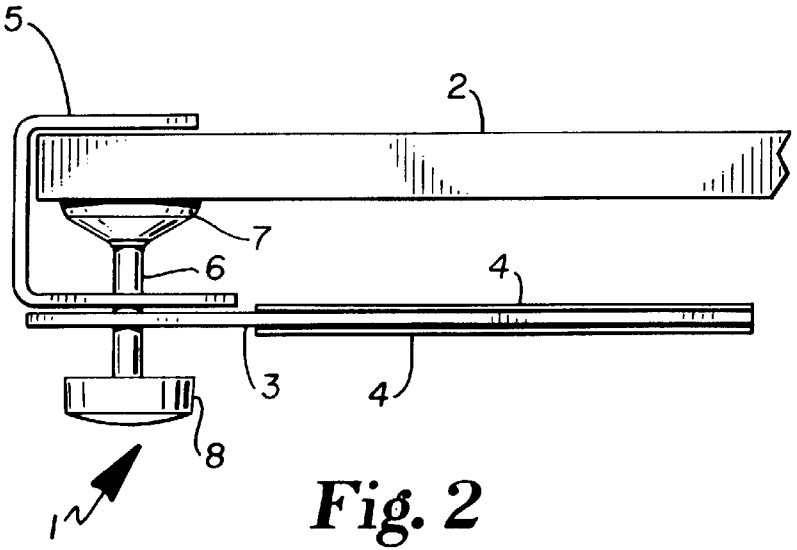
FIG. 2 is a side view of a mouse support in accordance with the invention.

To get a clear picture of the invention, it is advisable to inspect FIGS. 1 and 2 at the same time. However, the invention shown in the drawings is merely one example of an implement able solution. Other equivalent solutions are certainly possible.

For the sake of clarity, the drawings do not include detailed dimensions and do not show the real situation. Instead, an attempt has been made to depict the parts sufficiently clearly. Because of this, for example, parts which in practice are fixed together have been drawn as being separated from each other.

The mouse support 1 in accordance with the invention is shown in the drawings as being attached to the edge of a table top or a corresponding plate-like structure 2. The mouse support includes the actual base part 3, one side of which or, if needed, both sides of which are covered by a layer 4, made of a suitable material and against which the ball of the mouse can be rolled reliably.

As is best shown in FIG. 2, the base 3 is joined to a U-shaped attachment part 5. A tightening part 6, equipped with a screwing thread, goes through both the base and the U-shaped part. The inner end of the tightening part 6, i.e. the end inside the U-shaped attachment part, is equipped with a protective pad 7, or expanded part or similar, which rests against the under surface of the table top or plate-like structure to which the mouse support is fastened, thus preventing damage to its surface. The other end of the tightening part is equipped with a gripping part 8, sufficiently large to allow it to be gripped and turned and thus to fasten the whole support to the edge of the table top 2, for example.

The U-shaped attachment part 5 and the actual base part 3 are in such a position in relation to each other that the base 3 can be easily and freely rotated to a suitable position in relation to the attachment part 5, and thus it may be rotated to the desired working position from its storage position under the table top 2 for example. FIG. 1 shows, as an example, a stopping pin 9, which ensures the movement stops at the desired position. Pins, or other stopping devices, may be used to limit the movement of the base 3 in both directions, or they may be omitted.

The mouse support 1 in accordance with the invention must be installed so that either the base part is under the level of the table top or corresponding structure or, after turning it 180°, is above the table top, according to choice or need.

It is to be further noted that a mouse support in accordance with the invention must be located in relation to the attachment part in such a way that, if the base has been installed for rotation under the table top, for example, there should be enough space for the mouse resting on the base to fit in the area between the table top 2 and the base 3. Thus the mouse may be brought out, used and returned easily and effortlessly.

A useful way of making a simple and beneficial attachment between the attachment part 5 and the base 3 is to equip both parts with a hole having an internal thread corresponding to the external thread of the tightening part 6. The mouse support may be arranged so that when the base 3 is rotated to the desired extreme position, it will rotate on the thread of the tightening part 6 until it tightens against the surface of the attachment part 5 at the same point as its desired position. Thus an automatic stopper is formed for the rotating movement.

It is possible to achieve rotation of the base 3 around the attachment part 5, while at the same time ensuring that the parts stay in place, in many different ways that are familiar to professionals in different fields.

As mentioned above, both sides of the base 3 may be equipped with a suitable surface material. This is because both sides may be used as the resting base for the mouse depending on whether the base is installed above or below the table top.

Figure 3:
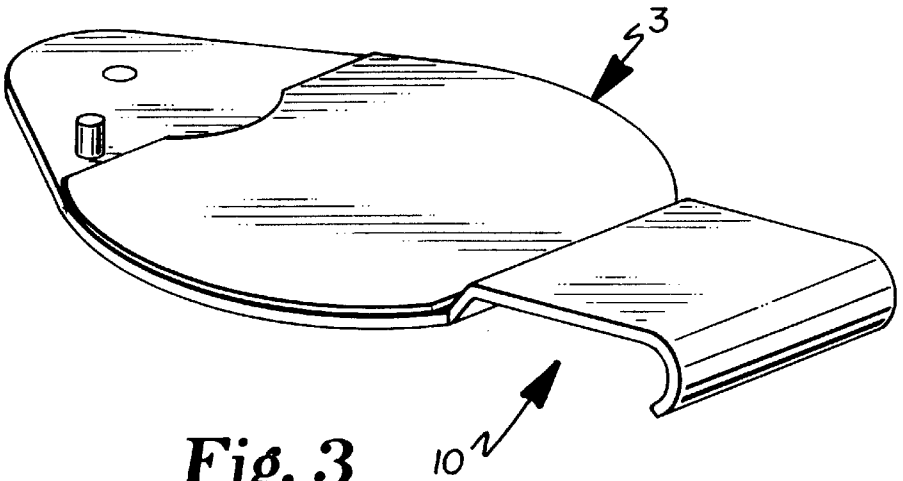
FIG. 3 shows a certain variation of a support in accordance with the invention.

FIG. 3 shows a certain variation of the base part 3 in which a wrist support 10 has been attached to the base part. In accordance with the invention this has been done in such a way that the base plate 3 has been bent into a structure rising above the level of the base, on which the wrist may rest when working with the mouse. It is clear that a wrist support may also be arranged in a normal way by using a raised cushion. The wrist support part may be made from a suitable material or may be covered with it.

The appropriate manufacturing material of the actual base part 3 in accordance with the invention and also of the attachment part 5 is a plastic-based material, although other materials may also be used. The attachment part can suitably be made from metal or a combination of plastic and metal. The tightening part 6 is suitably made from metal. For aesthetic or other reasons, the surfaces of a mouse support in accordance with the invention may be equipped with prints, stickers or corresponding covering parts, or the surfaces may be painted or otherwise surface treated.

We claim:

1. A mouse support (1), including a unitary, plate-like base part (3) and an attachment part (5), the attaching part attaching the base part (3) to a plate-like structure, wherein the attachment part (5) has a U-shaped body having an upper leg and a lower leg, wherein the base part (3) has a portion which overlaps the lower leg of the attachment part (5), wherein both the lower leg and the base part (3) have a mating aperture, wherein the mating aperture of the lower leg is aligned with the mating aperture of the base part (3), wherein the attachment part (5) further includes a tightening part (6) formed from a screwing part equipped with a thread, wherein the tightening part extends through the mating aperture of the lower leg and the mating aperture of the base part (3), wherein the base part (3) is attached to the thread of the tightening part (6) in order to rotate along the thread and possibly to be locked in a desired position because of the thread, wherein the tightening part secures the attachment part (5) to the plate-like structure, wherein said mouse support further comprises a stopper (9) constructed and arranged with respect to the base part (3) and the attachment part (5) to limit the swivel movement of the base part (3) around the tightening part (6), wherein the base part (3) swivels between a using position and a space-saving storage position around the tightening part (6), wherein a mouse resting on the base part (3) moves with the base part (3) between the using position and the storage position, and wherein the unitary, plate-like base part (3), the U-shaped attachment part (5), and the tightening part (6) provide an economical structure that is easily manufactured, assembled, and used.

2. The mouse support in accordance with claim 1, wherein the base part (3) is equipped with a raised part (10) to support the wrist.

3. The mouse support in accordance with claim 2, wherein the raised part (10) is a bent area of the base part.

4. The mouse support in accordance with claim 3, wherein the area of the raised part (10) is coated with material that feels pleasant to the skin.

5. A mouse support, comprising:

(a) a base part having a unitary, plate-like form, said base part having a hole, said hole having internal threads;

(b) a U-shaped attachment part for attaching said mouse support to a plate-like structure, said attachment part having an upper leg and a lower leg, said lower leg having an aperture, said attachment part further having a tightening part for securing said attachment part and said base part to said structure, said tightening part extending through said aperture of said lower leg, said tightening part having external threads cooperating with said internal threads of said hole, wherein said tightening part extends through said hole of said base part, and wherein said base part rotates along said external threads on said tightening part between a use position and a storage position;

(c) a raised part to support a wrist, said raised part being formed from a bent area of said base part; and (d) a stopper connected to said base part and constructed an arranged with respect to said base part and said attachment part to limit the swivel movement of said base part around said tightening part;

wherein said base part, said attachment part, and said tightening part provide an economical, space-saving and flexible structure that is easily manufactured, assembled and used, and wherein said base part, said attachment part, and said tightening part are constructed and arranged to allow the mouse support to be operably attached either above or below the structure.

6. A mouse support, comprising:

(a) a base part having a unitary, plate-like form to enable a mouse to be operably moved on said base part, said base part including an attachment portion having a mating aperture, said attachment portion forming an integral part of said unitary, plate-like base part, wherein one side of the base part is covered with a suitable material and against which the ball of the mouse can be rolled reliably; and (b) an attachment part, said attachment part attaching said base part to a plate-like structure, said attachment part including:

(i) a U-shaped body having an upper leg and a lower leg, said lower leg overlapping said attachment portion of said base part, said lower leg having a mating aperture aligned with said mating aperture of said attachment portion; and (ii) a tightening part formed from a screwing part equipped with a thread, said tightening part extending through said mating aperture of said lower leg and said mating aperture of said base part, said tightening part securing said attachment part to said plate-like structure, said base part swiveling between a using position and a space-saving storage position around said tightening part, said mouse moving with said base part between said using position and said storage position, said unitary, plate-like base part, said U-shaped attachment part, and said tightening part providing an economic structure that is easily manufactured, assembled, and used.

7. The mouse support of claim 6, wherein said base part has a raised part for supporting a mouse operator's wrist, said raised part being a bent area of said base part, said raised part being coated with material that feels pleasant to a mouse operator's skin.

* * * * *